US009060552B2

(12) United States Patent
Lekkas

(10) Patent No.: US 9,060,552 B2
(45) Date of Patent: Jun. 23, 2015

(54) GARMENT CONSTRUCTION

(76) Inventor: Anastasia Lekkas, New York, NY (US)

( * ) Notice: Subject to any disclaimer, the term of this patent is extended or adjusted under 35 U.S.C. 154(b) by 161 days.

(21) Appl. No.: 13/529,424

(22) Filed: Jun. 21, 2012

(65) Prior Publication Data

US 2012/0324617 A1 Dec. 27, 2012

Related U.S. Application Data

(60) Provisional application No. 61/499,483, filed on Jun. 21, 2011, provisional application No. 61/500,838, filed on Jun. 24, 2011.

(51) Int. Cl.
*A41D 1/22* (2006.01)
*A41D 15/00* (2006.01)

(52) U.S. Cl.
CPC .... *A41D 1/22* (2013.01); *Y10S 2/02* (2013.01); *A41D 15/005* (2013.01)

(58) Field of Classification Search
CPC ..... A41D 1/22
USPC ..... 2/69, 74, 104
See application file for complete search history.

(56) References Cited

U.S. PATENT DOCUMENTS

| | | | | | |
|---|---|---|---|---|---|
| 383,550 | A * | 5/1888 | Woolf | 2/105 |
| 2,479,091 | A * | 8/1949 | Ackley | 2/74 |
| 2,493,531 | A * | 1/1950 | Fitches | 2/115 |
| 3,116,491 | A * | 1/1964 | Previdi et al. | 2/106 |
| 4,494,248 | A * | 1/1985 | Holder | 2/69 |
| 5,083,316 | A * | 1/1992 | Kuehner | 2/67 |
| 5,592,691 | A * | 1/1997 | Ronald | 2/69 |
| 5,894,600 | A * | 4/1999 | Chenefront | 2/69 |
| 6,047,404 | A * | 4/2000 | Blanks, I | 2/69 |
| 6,611,964 | B2 * | 9/2003 | Lipsett et al. | 2/227 |
| 8,272,072 | B1 * | 9/2012 | Fowler | 2/265 |
| 2012/0023643 | A1 * | 2/2012 | O'Connell | 2/228 |

* cited by examiner

*Primary Examiner* — Khoa Huynh
*Assistant Examiner* — Anna Kinsaul
(74) *Attorney, Agent, or Firm* — Gottlieb, Rackman & Reisman, P.C.

(57) ABSTRACT

A garment is constructed of a plurality of interchangeable panels. A mirror pair of side panels is selectively attached to a center panel by various attachment means, e.g., a zipper. Each panel includes two designed surfaces, an inner surface and an outer surface, where the inner surface and the outer surface are interchangeable. Accordingly, a complete garment can be configured having various color and design pattern fabric combinations in similar concepts and different designs or cuts.

9 Claims, 5 Drawing Sheets

FIG. 1
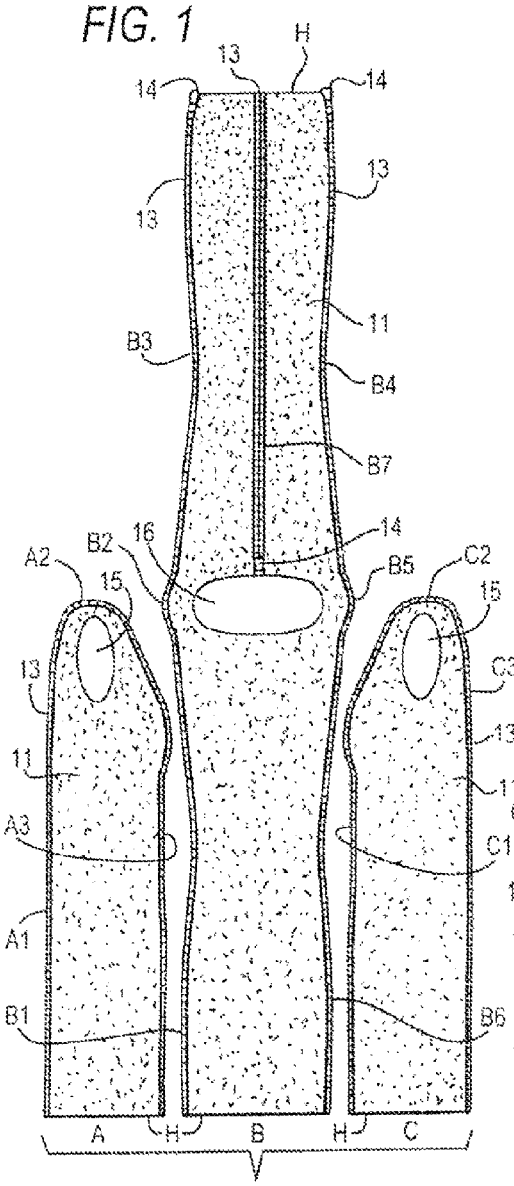
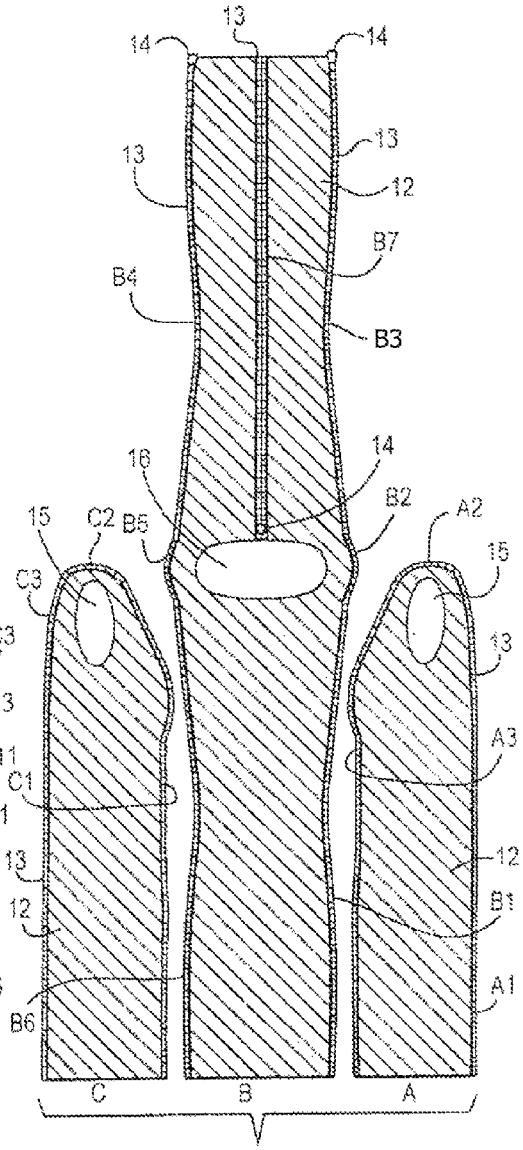
FIG. 2

FIG. 3
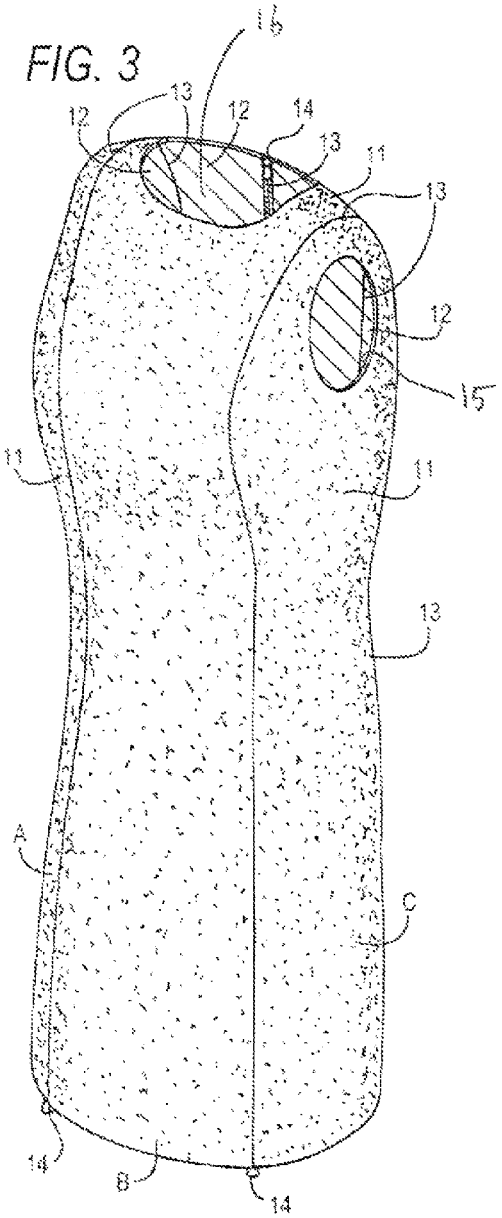
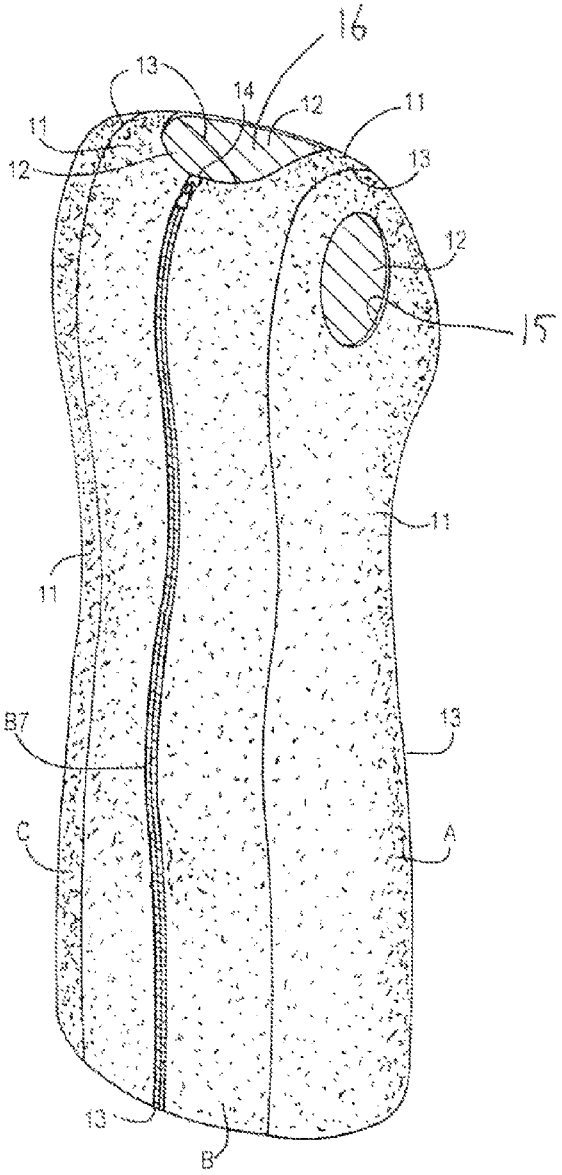
FIG. 4

FIG. 5
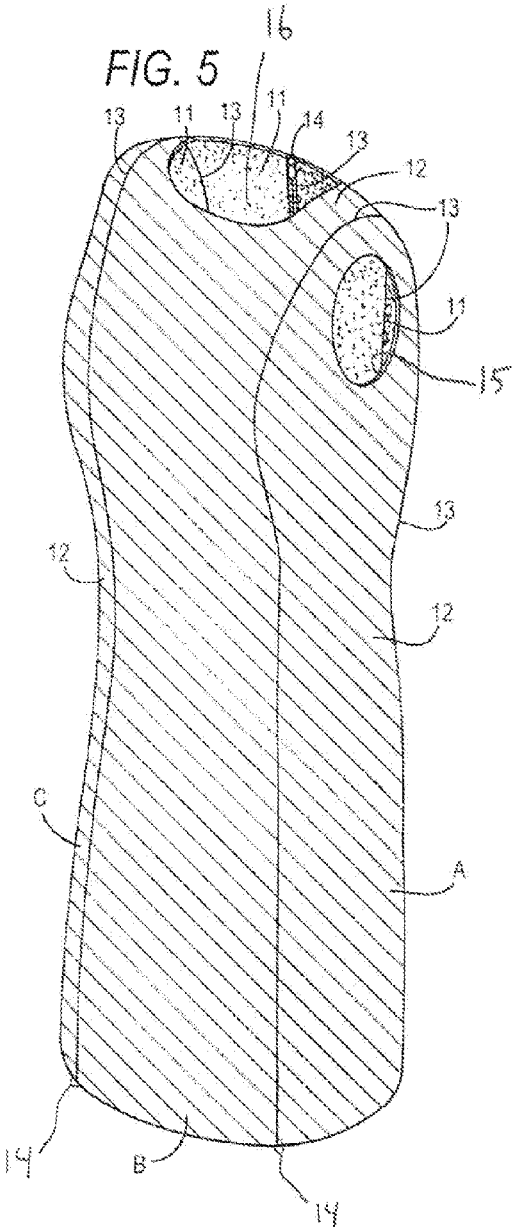
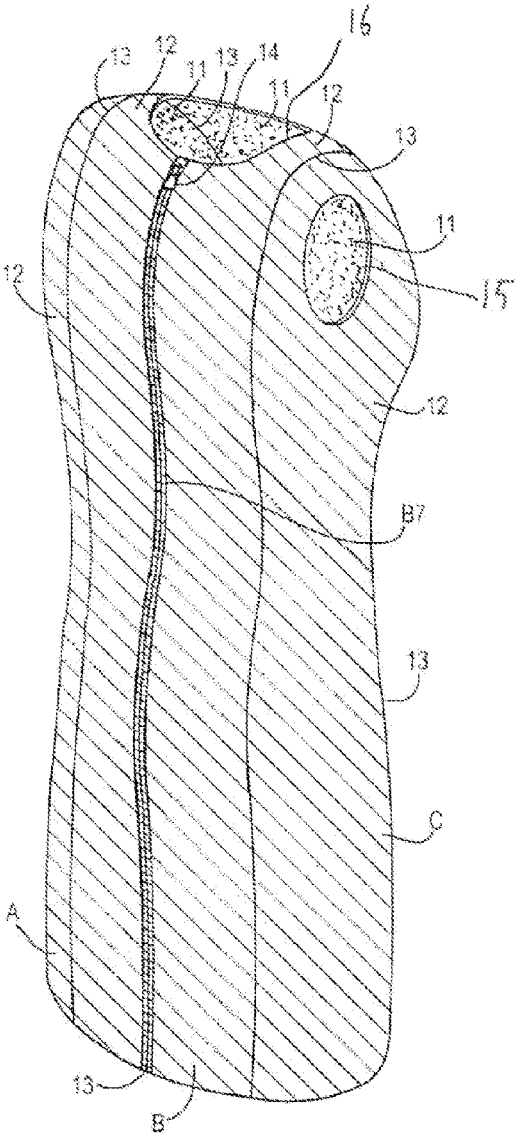
FIG. 6

FIG. 9
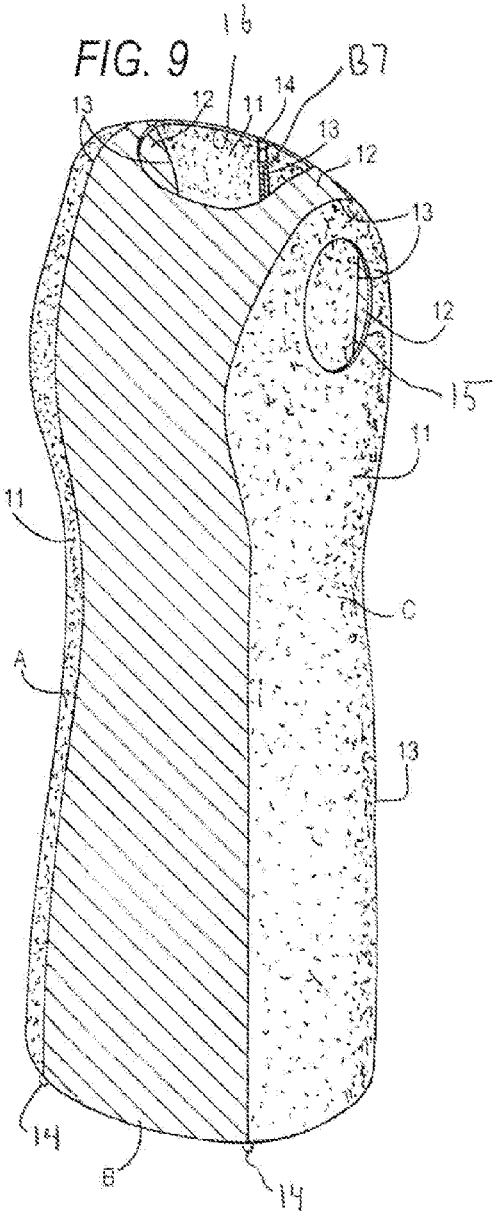
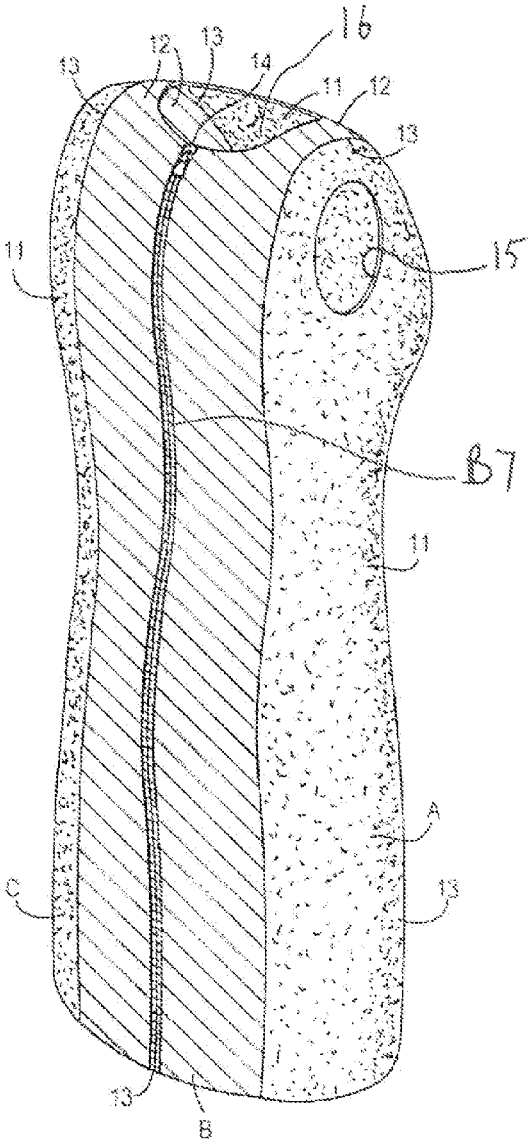
FIG. 10

GARMENT CONSTRUCTION

RELATED APPLICATIONS

This application claims priority to U.S. Provisional Patent Application No. 61/499,483, filed on Jun. 21, 2011 and U.S. Provisional Patent Application No. 61/500,838, filed on Jun. 24, 2011, both of which are hereby incorporated by reference.

FIELD OF INVENTION

This invention relates to the construction of a feminine garment(s), which can be changed by the use of specific attachment means such as zippers separating the garment into pieces and/or panels and reattaching them, to provide for various color and design pattern fabric combinations. The various color and design pattern fabric combinations are provided by the specific garment designs constructed in similar concepts and different designs or cuts.

BACKGROUND

Traditionally, garments are constructed to provide a singular look. For example, a blouse may be manufactured in a variety of colors or patterns, each for separate purchase. In order for a wearer to achieve a different appearance, multiple items must be purchased. An alternative to this is reversible clothing. Using reversible clothing, a wearer may achieve two separate appearances, the first by wearing a garment one way and the second by reversing the garment (for example, by turning the garment inside out).

SUMMARY OF THE INVENTION

It is a feature of the present invention to provide a garment that is characterized by the capability of the garment to be reconstructed in various design combinations where a separating and attaching mechanism, such as a zipper or zippers are used to separate or attach panels of the garment.

It is another feature of the present invention to provide a garment that allows for various combinations wherein the combinations are made possible by attachment means such as zippers which are placed along the various cuts in the design construction of the garment.

It is another object of the invention to construct four garments with different exterior looks, from three garment panels.

Additional features and advantages of the invention will be apparent from the following detailed description, which illustrates, by way of example, features of the invention.

BRIEF DESCRIPTION OF THE DRAWINGS

With reference to the drawings, comprising a portion of the present disclosure:

FIG. 1 is a first side view of a plurality of panels that make up a dress;

FIG. 2 is reverse side view of the plurality of panels that make up the dress in FIG. 1;

FIG. 3 is a front perspective view of the dress construction of FIG. 1 with all panels connected;

FIG. 4 is a rear perspective view of the dress construction of FIGS. 1 and 3;

FIG. 5 is a front perspective view of the dress construction of FIG. 2 with all panels connected;

FIG. 6 is a rear perspective view of the dress construction of FIGS. 2 and 5;

FIG. 9 is another front perspective view of a dress construction with differing panels all connected; and FIG. 10 is a rear perspective view of the dress construction of FIG. 9.

DETAILED DESCRIPTION OF THE DRAWINGS

Figure 7:
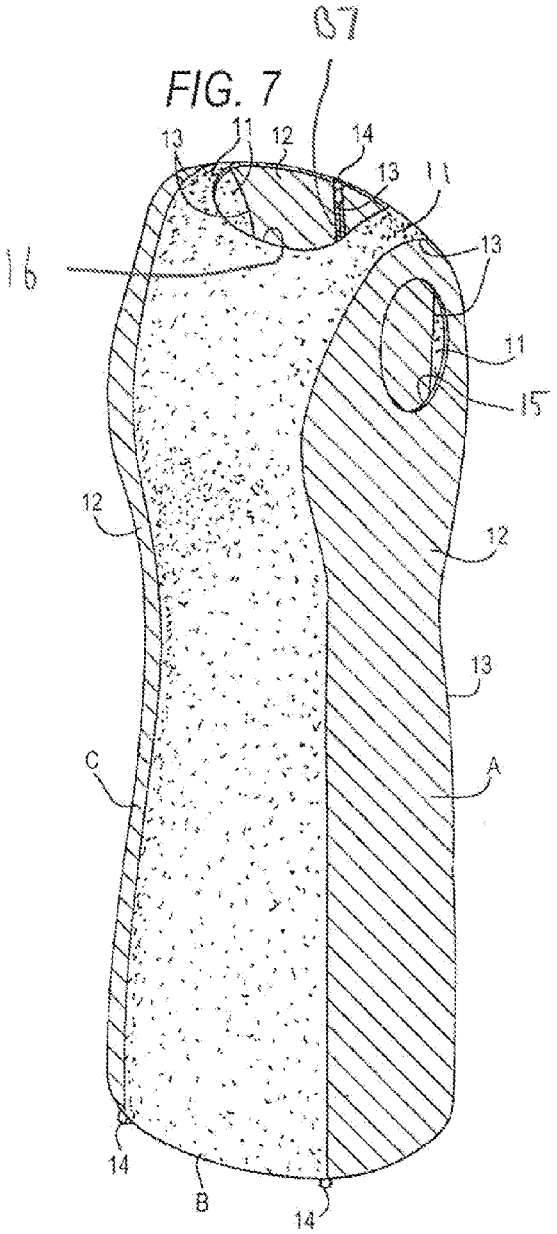
FIG. 7 is a front perspective view of a dress construction with differing panels all connected.

The preferred embodiment of the present invention relates to a princess line dress (also known as a princess seem dress) wherein an attachment means connects or disconnects each panel of the dress construction. However, alternative embodiments, such as blouses or shirts, pants, skirts, and jackets may be constructed using the same construction and method. In the preferred embodiment, zippers are used as attachment means and are sewn in different cuts and locations of the garments.

As illustrated in FIGS. 1-10, the preferred embodiment of the princess dress comprises three panels—side panel A, central panel B, and side panel C. Each panel has at side edges thereof an attachment means (e.g., a zipper, buttons, hook and loop fasteners, etc.) and has two different "looks" on each side of each panel. Such different "looks" may be achieved by the use of different fabrics, designs or colors, on the front and back of each panel. As illustrated in FIG. 1, side panels A and B further include arm openings 15, and central panel B further includes neck opening 16. In alternative embodiments, the panels A, B, C may be "mixed and matched" to construct multiple types of dresses such as a mini or cocktail dress or a long maxi or gown dress.

By way of example, each panel contains reversible zippers 13 that attach the three panels A, B, C. In alternative embodiments, the attachment means may be hook and eye, VELCRO® (e.g., hook and loop fastener), buttons, or the like.

Zippers may be obtained from KEE Zippers Corporation Limited, 2101A Tower 2, China Hong Kong City, 33 Canton Road, T. S. T, Kowloon, Hong Kong. Other manufacturers make similar zippers.

Where a zipper is used, alternative embodiments exist that allow the zipper pull 14 to be constructed of a logo, jewel, or another fashionable accessory that can double as a zipper pull. The embodiments that use a zipper attachment means include a type of zipper that goes around each of the cut panels A, B, C and finishes at the hem H. Furthermore, alternative embodiments may provide additional or fewer panels.

FIGS. 1-10 further illustrate that each panel A, B and C is made of two sides, a first face 11 and a second face 12, which are both constructed of material which is suitable for the exterior of the garment. The faces, 11 and 12 are coextensive, forming opposite faces of the same panel. In other words, each panel is reversible to provide additional flexibility in the appearance of the dress.

By way of example, each panel may contain a front side having a solid color and a back side having a pattern. In alternative embodiments, the front side and back side may include additional colors and patterns. Each panel may be of a different color or print on each side, or each panel may be made of two fabrics, sewn together in a conventional manner, with each fabric being of a different design or color.

Referring to FIG. 1, panel A is illustrated in the shape of a side of a dress and has a back edge length A1, a top edge length A2 and a front edge length A3, forming the perimeter of the panel, except for the hem length H. Each zipper 13, as is conventional, has two interconnecting halves, and one such half runs along lengths A1, A2 and A3.

Center Panel B is generally in the shape of the front and back of a dress, and has front edge length B1, top side edge length B2, rear side length B3, rear side edge B4, top side edge length B5, and front side length B6. Lengths B1 through B6 form the periphery of the panel B, except at the hem H. A half of zipper 13 run along lengths B1 through B6, except at the hem H.

Side Panel C similarly has front side length C1, top side length the C2 and back side length C3; zipper 13 runs along these lengths.

Desirably lengths A1, A2 and A3 are equal in length to lengths B1 and B2 and B3 while lengths C1, C2 and C3 are equal in length to lengths B4, B5 and B6, such that panels A and C are mirror images of one another.

It is noted that center panel B at its upper back segment is optionally divided by a zipper at its middle B7 for ease of entering into or existing from the dress by a wearer.

In the fabrication of the garment, in order to allow for flexibility of movement (due to the limitation imposed by zipper tape/teeth which are firm) the fabrication should include a percentage of spandex or another stretchable material.

The panels A, B and C, as shown in FIG. 1, have their faces 11 on the exterior, when the dress of FIG. 3 and FIG. 4 is formed. The panels A, B and C as shown in FIG. 2 have their faces 12 on the exterior, when the dress of FIGS. 5 and 6 is formed. Accordingly, two dresses having difference exteriors may be formed.

Figure 8:
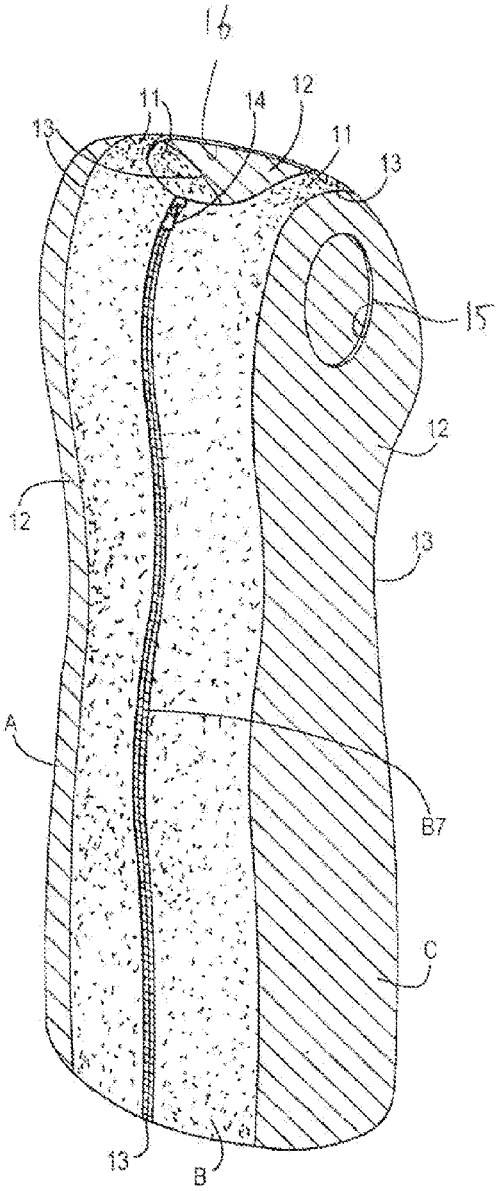
FIG. 8 is a rear perspective view of the dress construction of FIG. 7.

Since panels A and C are interchangeable, other combinations are readily formed to make dresses of difference appearances. FIGS. 7 and 8 show another dress combination of panels A, B, C, wherein, as seen in FIG. 7, panel C is on the left, with its face 12 on the exterior, and panel A is on the right, with its face 12 on the exterior. FIG. 8 is a rear view of the dress of FIG. 7. The center panel B has its face 11 on the exterior, thereby creating a dress having an overall exterior that varies from the dress shown in FIGS. 1-6.

FIGS. 9 and 10 show another dress combination of panels A, B, C where, as seen in FIG. 9, panel A is on the left and panel C is on the right, panel A having its face 11 on the exterior and panel C having its face 11 on the exterior. In this combination, the second face 12 of panel B is positioned on the exterior creating a fourth unique design.

Desirably, the panels A, B, C when connected by zippers, fit edge to edge in a neat true fashion, see FIGS. 3 and 4.

It should also be noted that a wearer may combine multiple dresses having varying panel designs to form even more combinations of garments. For example, a user may combine a dress having black and white panels with a dress having green and blue panels to form many more dress combinations.

The accompanying drawings only illustrate a dress construction, its constituent parts, and method of use. However, other types and styles are possible, and the drawings are not intended to be limiting in that regard. Thus, although the description above and accompanying drawings contains much specificity, the details provided should not be construed as limiting the scope of the embodiment(s) but merely as providing illustrations of some of the presently preferred embodiment(s). The drawings and the description are not to be taken as restrictive on the scope of the embodiment(s) and are understood as broad and general teachings in accordance with the present invention. While the present embodiment(s) of the invention have been described using specific terms, such description is for present illustrative purposes only, and it is to be understood that modifications and variations to such embodiments, including but not limited to the substitutions of equivalent features, materials, or parts, and the reversal of various features thereof, may be practiced by those of ordinary skill in the art without departing from the spirit and scope of the invention.

The invention claimed is:

1. A garment construction for a dress, comprising three panels:

a first side panel having a first face, a second face, a first edge, and a first hem edge, the first edge and the first hem edge forming the entire periphery of the first side panel, the first side panel forming an entire side of said dress, the first face and the second face of the first side panel having different looks;

a second side panel having a first face, a second face, a second edge, and a second hem edge, the second edge and the second hem edge forming the entire periphery of the second side panel, the shape of the first panel mirroring the shape of the second panel, and the second side panel forming another entire side of said dress, the first face and the second face of the second side panel having different looks; and a center panel having a first face, a second face, the first and second faces each being a single piece of material, the center panel further comprising a third edge, a third hem edge, a fourth edge, and a fourth hem edge, wherein the third edge, third hem edge, fourth edge, and fourth hem edge form the entire periphery of the center panel, the center panel forming both a front and back of the dress when the first and second side panels are attached and the center panel having a central neck opening, wherein the first side panel, the second panel and the center panel form an entire, substantially tubular dress without other panels, wherein the first and second side panels attach to and detach from the center panel by attachment means provided on the entire first, second, third, and fourth edges of the panels, said first edge being releasably attachable to the third edge, said second edge being releasably attachable to the fourth edge, wherein when the first, second, and center panels are attached, the first, second, third and fourth hem edges are aligned and form a continuous bottom hem edge of the dress, and whereby the first side panel, the second side panel and the center panel are each entirely and independently reversible and attachable to form the dress, which is configurable into at least four different looks.

2. The garment construction of claim 1, wherein the attachment means includes at least two zippers, each of the zippers having a first half and a second half, one of the first half and the second half extending about the first edge of the first side panel, the second edge of the second side panel, the third edge of the center panel and the fourth edge of the center panel, with the first side panel and the second side panel adapted to attach to an detach from the center panel by the zippers.

3. The garment construction of claim 1, wherein each side panel includes an arm opening, and the center panel includes a neck opening.

4. The garment construction of claim 1, wherein the first face of the first side panel, the first face of the second side panel, and the first face of the center panel uniformly present a first design, and the second face of the first side panel, the second face of the second side panel, and the second face of the center panel uniformly present a second design, said designs being different so as to construct garments of at least two of the exterior garment configurations.

5. The garment construction of claim 1, wherein the attachment means are selected from a group consisting of a zipper, buttons, and hook and eye fasteners.

6. The garment construction of claim 1, wherein each of the first side panel, the second side panel and the center panel include an outer fabric layer and an inner fabric layer, and wherein the outer layer is of a different pattern than the inner layer, and each panel is reversible and interchangeable so that both the outer fabric layer and the inner fabric are configurable to be alternatively on the exterior or the interior of the garment.

7. The garment construction of claim 1, wherein each of the first side panel, the second side panel and the center panel has an outer fabric layer and an inner fabric layer, and wherein the outer fabric layer is of a different color than the inner fabric layer, and each panel is reversible and interchangeable so that one of the outer fabric layer and the inner fabric layer is on the outside of the garment.

8. A garment construction for a dress, comprising three panels:

a first side panel having a front face, a back face, a first edge, and a first hem edge, the first edge and the first hem edge forming the entire periphery of the first side panel, the first side panel forming an entire side of said dress, the front face and the back face of the first side panel having different looks;

a second side panel having a front face, a back face, a second edge, and a second hem edge, the second edge and the second hem edge forming-the entire periphery of the second side panel, the shape of the first panel mirroring the shape of the second panel, and the second side panel forming another entire side of said dress, the front face and the back face of the second side panel having different looks; and a center panel having a front face, a back face, the front and back faces each being a single piece of material, the center panel further comprising a third edge, a third hem edge, a fourth edge, and a fourth hem edge, wherein the third edge, third hem edge, fourth edge, and fourth hem edge form the entire periphery of the center panel, the center panel forming both a front and back of the dress when the first and second side panels are attached and the center panel having a central neck opening, wherein the first side panel, the second panel and the center panel form an entire, substantially tubular dress without other panels, wherein the first and second side panels attach to and detach from the center panel by zipper halves provided on the entire first, second, third, and fourth edges of the panels, said first edge being releasably attachable to the third edge, said second edge being releasably attachable to the fourth edge, wherein when the first, second, and center panels are attached, the first, second, third and fourth hem edges are aligned and form a continuous bottom hem edge of the dress, and whereby the first side panel, the second side panel and the center panel are each entirely and independently reversible and attachable to form the dress, which is configurable into at least four single exterior looks.

9. The garment construction as set forth in claim 8, wherein the side panels and the center panel form a dress, and the faces of the side panels and the center panel have different designs to form four different exterior looks from a single garment.

* * * * *